US010803820B2

(12) United States Patent
He

(10) Patent No.: US 10,803,820 B2
(45) Date of Patent: Oct. 13, 2020

(54) METHOD OF DRIVING A DISPLAY PANEL AND A DISPLAY DEVICE

(71) Applicant: HKC Corporation Limited, Shenzhen (CN)

(72) Inventor: Huai Liang He, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/338,037

(22) PCT Filed: Aug. 15, 2018

(86) PCT No.: PCT/CN2018/100593
§ 371 (c)(1),
(2) Date: Mar. 29, 2019

(87) PCT Pub. No.: WO2019/047687
PCT Pub. Date: Mar. 14, 2019

(65) Prior Publication Data

US 2020/0027411 A1 Jan. 23, 2020

(30) Foreign Application Priority Data

Sep. 11, 2017 (CN) ..... 2017 1 0813634

(51) Int. Cl.
*G09G 3/36* (2006.01)

(52) U.S. Cl.
CPC ..... *G09G 3/3611* (2013.01); *G09G 3/3607* (2013.01); *G09G 2300/0452* (2013.01); *G09G 2310/08* (2013.01); *G09G 2320/0233* (2013.01); *G09G 2320/0247* (2013.01); *G09G 2320/10* (2013.01)

(58) Field of Classification Search
None
See application file for complete search history.

(56) References Cited

U.S. PATENT DOCUMENTS

2015/0339989 A1* 11/2015 Hasegawa ..... G09G 3/3674 345/694

FOREIGN PATENT DOCUMENTS

CN 106981276 A * 7/2017 ..... G09G 3/36

* cited by examiner

*Primary Examiner* — Kenneth B Lee, Jr.
(74) *Attorney, Agent, or Firm* — WPAT, PC

(57) ABSTRACT

The present application relates to a driving method and a display device for a display panel and the method comprises: dividing a pixel into a plurality of pixel groups and each pixel group comprising an adjacent first pixel unit and a second pixel unit; a first voltage signal and a second voltage signal for each pixel group in each frame image; adjusting the first voltage signal and the second voltage signal so that all the first and second voltage signals of each frame is the same as the average signal. The average signal of all the second voltage signals of each frame image is the same. The first voltage signal of the different pixel group is the same as the average signal of the multiple frame image, and the second voltage signal of the different pixel group is the same as the average signal of the multiple frame image.

20 Claims, 6 Drawing Sheets

| First Frame | | Second Frame | | Third Frame | | Fourth Frame | |
|---|---|---|---|---|---|---|---|
| A1-128 | A2-56 | A1-124 | A2-60 | A1-124 | A2-56 | A1-124 | A2-56 |
| A3-56 | A4-124 | A3-56 | A4-124 | A3-56 | A4-128 | A3-60 | A4-124 |
| A5-124 | A6-60 | A5-128 | A6-56 | A5-124 | A6-56 | A5-124 | A6-56 |
| A7-56 | A8-124 | A7-56 | A8-124 | A7-60 | A8-124 | A7-56 | A8-128 |

| First Frame | | Second Frame | | Third Frame | | Fourth Frame | |
|---|---|---|---|---|---|---|---|
| A1-128 | A2-56 | A1-124 | A2-60 | A1-128 | A2-56 | A1-124 | A2-60 |
| A3-60 | A4-124 | A3-56 | A4-128 | A3-60 | A4-124 | A3-56 | A4-128 |
| A5-124 | A6-60 | A5-128 | A6-56 | A5-124 | A6-60 | A5-128 | A6-56 |
| A7-56 | A8-128 | A7-60 | A8-124 | A7-56 | A8-128 | A7-60 | A8-124 |

Figure 5

| First Frame | | Second Frame | | Third Frame | | Fourth Frame | |
|---|---|---|---|---|---|---|---|
| A1-128 | A2-56 | A1-128 | A2-60 | A1-128 | A2-60 | A1-124 | A2-60 |
| A3-60 | A4-124 | A3-60 | A4-128 | A3-60 | A4-128 | A3-56 | A4-128 |
| A5-128 | A6-60 | A5-128 | A6-56 | A5-124 | A6-60 | A5-128 | A6-60 |
| A7-60 | A8-128 | A7-60 | A8-124 | A7-56 | A8-128 | A7-60 | A8-128 |

Figure 6

| First Frame | | Second Frame | | Third Frame | | Fourth Frame | |
|---|---|---|---|---|---|---|---|
| A1-124 | A2-56 | A1-124 | A2-56 | A1-124 | A2-56 | A1-124 | A2-56 |
| A3-56 | A4-124 | A3-56 | A4-124 | A3-56 | A4-124 | A3-56 | A4-124 |
| A5-124 | A6-56 | A5-124 | A6-56 | A5-124 | A6-56 | A5-124 | A6-56 |
| A7-56 | A8-124 | A7-56 | A8-124 | A7-56 | A8-124 | A7-56 | A8-124 |

Figure 7

METHOD OF DRIVING A DISPLAY PANEL AND A DISPLAY DEVICE

FIELD OF THE DISCLOSURE

The present application relates to the display technology, and more particularly to a method of driving a display panel and a display device.

BACKGROUND

The exemplary liquid crystal display technology uses a 6-bit driver IC to implement octet quality resolution and uses FRC (Frame rate control) technology to combine two adjacent gray steps to cut out more grayscale. It will show the target gray scale through a number of frames to achieve by a number of frames in the number of display In order to achieve the visual retention of the human eye to feel the equivalent brightness of the presentation.

However, the six-bit driver IC can only achieve the octave luminance signal of the 124-level luminance signal and the 128-level luminance signal, and the 56-level luminance signal and the 60-level luminance signal octet resolution display when the 125-level luminance signal and the 57-level luminance signal are displayed. Therefore, it needs to be compared and displayed by multiple frames. If the average brightness of the ratio is different, it will be changed by the brightness and darkness through human eye temporarily and it will also be felt by the human eye of the obvious unequal brightness flicker.

SUMMARY

Based on this, it is necessary to provide a driving method of a display panel and display device in view of the low-frequency luminance flicker problem.

A driving method of a display panel includes:

dividing a pixel into a plurality of pixel groups and each of the pixel group comprise a first pixel unit and a second pixel unit which are adjacent to each other;

displaying an image with multiple frames in sequence;

obtaining a first voltage signal and a second voltage signal for each pixel group in each frame, wherein the first pixel unit is driven by the first voltage signal, and the second pixel unit is driven by the second voltage signal, and the first voltage signal being higher than said second voltage signal; and adjusting the first voltage signal and the second voltage signal so that the average signal of the first voltage signals of each frame is the same, and the average signal of all the second voltage signals of each frame is the same, and the first voltage signal in the different pixel groups is the same as the average signal of the multiple images, and the second voltage signal of the different pixel group is the same as the average signal of the multiple images.

In one of the embodiments, the first pixel unit and the second pixel unit are arranged adjacent in the same row.

In one of the embodiments, a driving method, wherein the first pixel unit of one of the two adjacent pixel groups is neighboring to the second pixel unit of the other of pixel groups in the same row. In one of the embodiments, the first pixel unit and the second pixel unit are arranged adjacent in the same row. In one of the embodiments, a driving method, wherein the first pixel unit of one of the two adjacent pixel groups is neighboring to the second pixel unit of the other of pixel groups in the same row.

In one of the embodiments, the driving method, wherein one frame image is the four-frame image. In one of the embodiments, the driving method, wherein the first voltage signal is higher than the second voltage signal.

A display device includes:

a display panel dividing into multiple pixel groups, and each of the pixel group comprising a first pixel unit and a second pixel unit are adjacent to each other;

a driving module for sequentially displaying each image with multiple frames and obtaining a first voltage signal and a second voltage signal for each pixel group in each frame; wherein the first pixel unit is driven by the first voltage signal, the second pixel unit is driven by the second voltage signal, and the first voltage is not equal to the second voltage signal;

adjusting the first voltage signal and the second voltage signal so that the average signal of all the first voltage signals of each frame is the same, and the average signal of all the second voltage signals of each frame is the same, the first voltage signal of the different pixel group is the same as the average signal of multiple frames, and the second voltage signal of the different pixel group is the same as the average signal of multiple frames.

In one of the embodiments of the display device, wherein the first pixel unit of one of the two pixel groups and the second pixel unit of the other pixel group are arranged adjacent in the same row.

A driving method of a display panel includes:

dividing the pixel into at least one pixel group, and each pixel group comprising a first pixel unit and a second pixel unit are adjacent to each other;

displaying image with one frame in sequence;

obtaining a first voltage signal and a second voltage signal for each pixel group in each frame; wherein the first pixel unit is driven by the first voltage signal, the second pixel unit is driven by the second voltage signal, and the first voltage is higher than the second voltage signal;

adjusting the first voltage signal and the second voltage signal so that the average signal of all the first voltage signals of each frame is the same, and the average signal of all the second voltage signals of each frame is the same, the first voltage signal of the different pixel group is the same as the average signal of one frame, and the second voltage signal of the different pixel group is the same as the average signal of one frame.

The above driving method and the display device use the high and low voltage pixel to drive the modes of the multiple frame period. The average signal of all the high voltage signals of each frame image is the same, and the average signal of all the low voltage signals of each frame image is the same. The high voltage signal of the pixel group is the same as the average signal of the multiple frame image, and the low voltage signal of the different pixel group is the same as the average signal of the multiple frame image. Therefore, the timing of presenting the same brightness signal solves the problem of low-frequency brightness flicker.

BRIEF DESCRIPTION OF THE DRAWINGS

FIG. 5 is a schematic representation of a voltage signal of a sub-pixel of another embodiment;

FIG. 6 is a schematic diagram of a voltage signal of a sub-pixel of another embodiment;

FIG. 7 is a schematic diagram of a voltage signal of a sub-pixel of another embodiment;

The realization, functional features and advantages of the objectives of the disclosure will be further described in conjunction with embodiments and with reference to the accompanying drawings.

DETAILED DESCRIPTION OF PREFERRED EMBODIMENTS

It is to be understood that the specific embodiments described herein are merely illustrative of the disclosure and are not intended to be limiting of the disclosure.

In order to understand this application easily, the present application will be described more with the reference to the accompanying drawings. A preferred embodiment of the present application is given in the accompanying drawings. However, the present application may be embodied in many different forms and is not limited to the embodiments described here. On the contrary, the purpose of providing these embodiments is to make the understanding of the disclosure of the present application more thorough and comprehensive.

Figure 1:
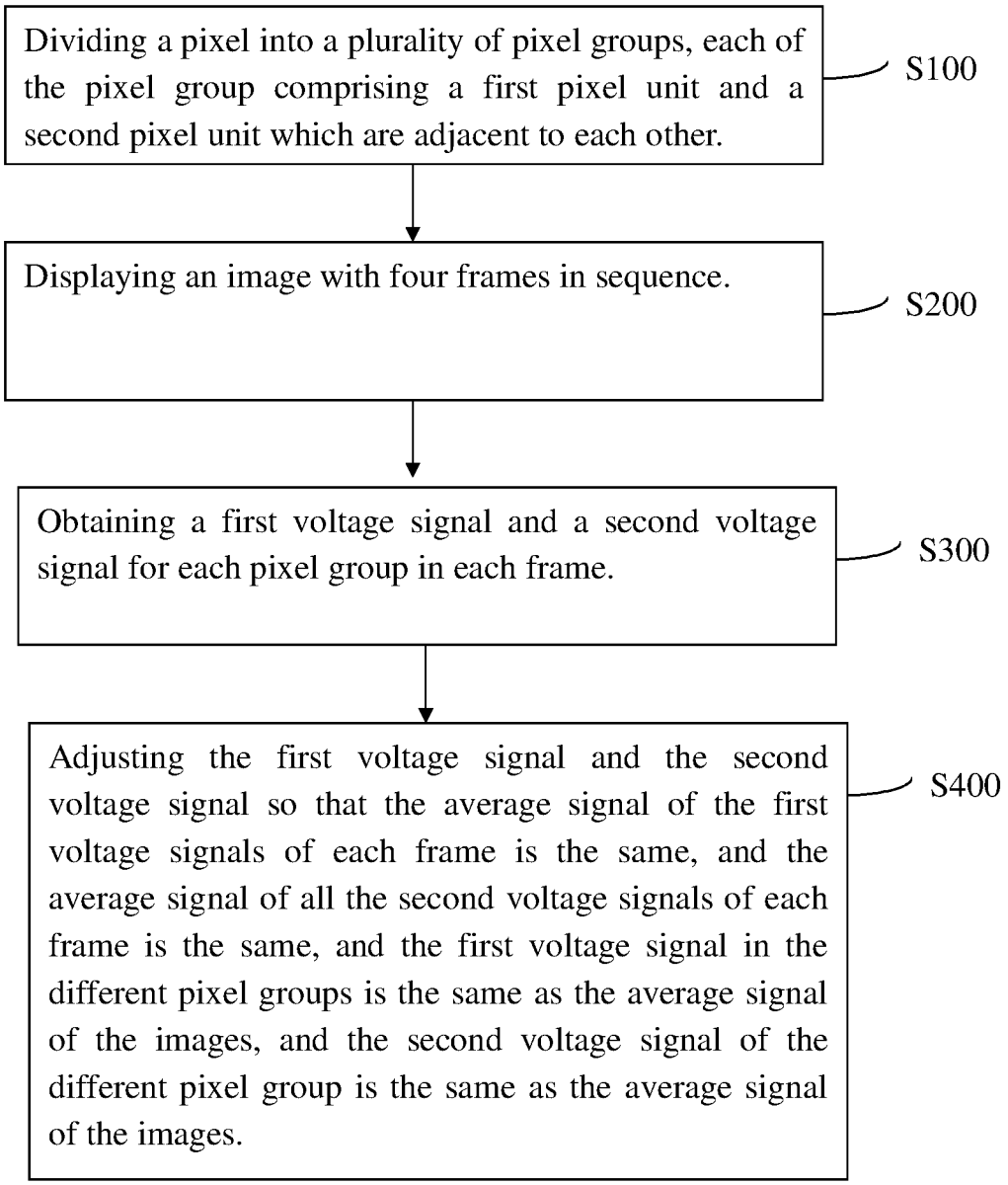
FIG. 1 is a flow chart of a driving method of a display panel of an embodiment.

Unless otherwise defined, all technical and scientific terms used herein have the same meaning as commonly understood by one skilled in the art to which this application belongs. The terminology used herein in the specification of the application is for the purpose of describing the specific examples only and is not intended to limit the present application. The term & quot; and/or & quot; as used comprises any and all combinations of one or more of the associated listed items FIG. 1 is a flow chart of a driving method of a display panel of an embodiment. The driving method includes:

Step S100: dividing a pixel into a plurality of pixel groups, each of the pixel group comprising a first pixel unit and a second pixel unit which are adjacent to each other.

Specifically, each pixel unit comprises sub-pixels of three colors, red sub-pixels, green sub-pixels and blue sub-pixels, and the driving voltage between adjacent sub-pixels is opposite in polarity.

Step S200: displaying image with multiple frames in sequence.

Specifically, the multiple frame image is a four-frame image, which is a first frame image, a second frame image, a third frame image, and a fourth frame image For example, a 6-bit driver IC is used to achieve an 8-bit display. The 6-bit driver IC intelligently displays 64 grayscale and the 8-bit display requires 256 grayscale. So FRC (Frame Rate Control) can be displayed in order by four images. With the visual inertia of the human eye, the effect of 8-bit display can be presented by 6-bit panel by appropriate control frame rate and the gray scale signal between adjacent frames.

Step S300: obtaining a first voltage signal and a second voltage signal for each pixel group in each frame; wherein the first pixel unit is driven by the first voltage signal, the second pixel unit is driven by the second voltage signal, and the first voltage is not equal to the second voltage signal.

Specifically, the first voltage signal is higher than the second voltage signal. That is, the first voltage signal is a high voltage signal and the second voltage signal is a low voltage signal.

Furthermore, the first voltage signal and the second voltage signal are corresponding to different signal values. For example, the first voltage signal corresponds to a signal 124 and 128. The second voltage signal corresponds to a gray level 56 and 60. Besides, the first voltage signal drives the red sub-pixel, the green sub-pixel, and the blue sub-pixel in the first pixel unit, but the red sub-pixel, the green sub-pixel, and the blue sub-pixel have different signals.

Step S400: adjusting the first voltage signal and the second voltage signal. The average signal of all the first voltage signals of each frame image is the same and the average signal of all the second voltage signals of each frame image is the same. A voltage signal is the same as the average signal of the multiple frame image, and the second voltage signal of the different pixel group is the same as the average signal of the multiple frame image.

In the driving method of a display panel provided in the above embodiment, the average signal of all the high voltage signals of each frame image is the same as the average signal of all the low voltage signals of each frame image by the high and low voltage pixel driving modes of the multiple frame period. The average signal is the same. The high voltage signal of different pixel group is the same as the average signal of the multiple frame image, and the low voltage signal of different pixel group is the same as the average signal of the multiple frame image. Therefore, the timing of presenting brightness signal solves the problem of low-frequency brightness flicker.

Figure 2:
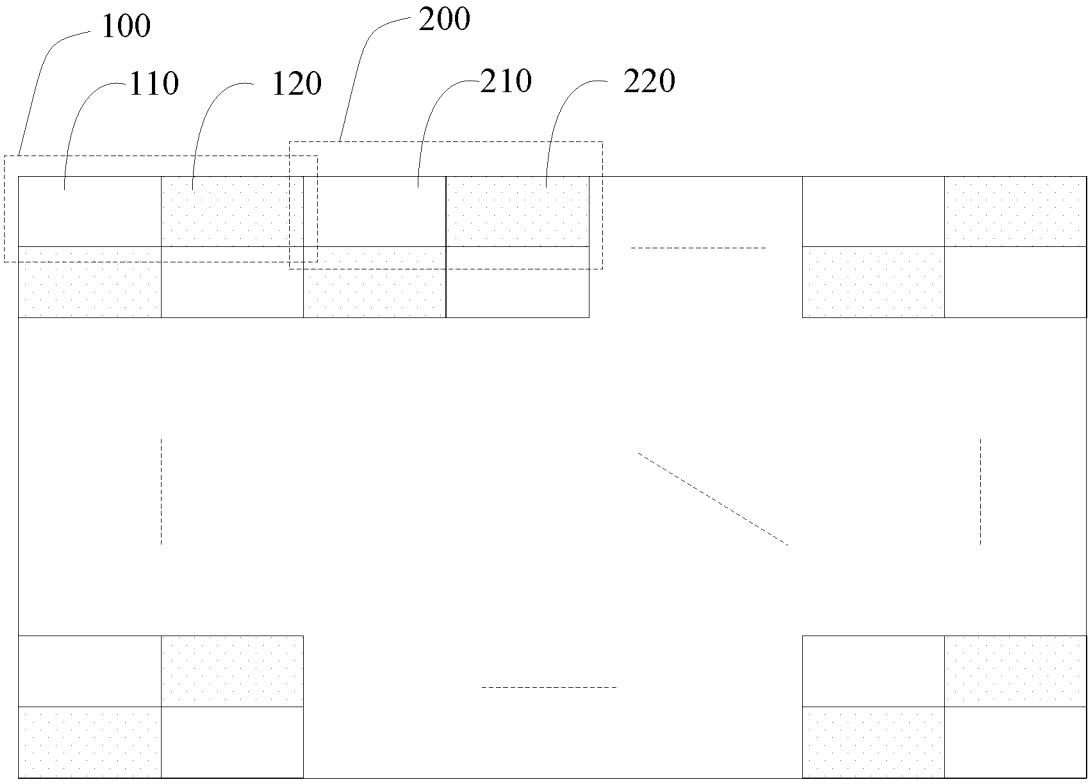
FIG. 2 is a schematic illustration of a pixel group arrangement of one embodiment.

In one of the embodiments, as shown in the FIG. 2, the first pixel unit 110 and the second pixel unit 120 are arranged adjacent in the same row in the Step S100.

Specifically, the first pixel unit 210 of one of the two adjacent pixel groups 200 is neighboring to the second pixel unit 120 of the other of pixel groups 100 in the same row.

Figures 3, 4:
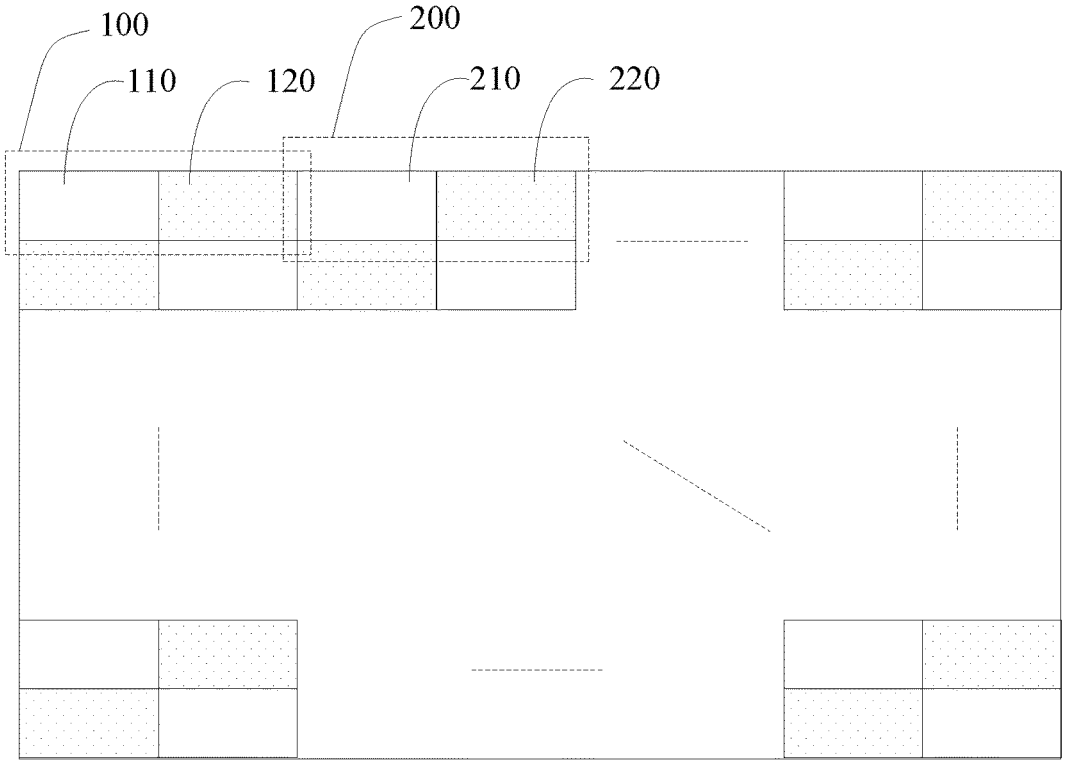
FIG. 3 is a schematic illustration of a pixel group arrangement of another embodiment.
FIG. 4 is a schematic diagram of a voltage signal of a sub-pixel of an embodiment.

It could be understood that the arrangement of the first pixel unit 110 and the second pixel unit 120 in the pixel group 100 are not limited to the above-described embodiment and be an arrangement as shown in FIG. 3; wherein the first pixel unit 110' is neighboring to the second pixel unit 120' in the same row.

Specifically, the first pixel unit 210' of one of the two adjacent pixel groups 200' is neighboring to the second pixel unit 120' of the other of pixel groups 100' in the same row.

In one of the embodiments, each pixel unit comprises sub-pixels of three colors, which are red sub-pixels, green sub-pixels and blue sub-pixels. The driving polarity between adjacent sub-pixels is opposite.

Specifically, one implementation of step S400 comprises below, taking an 8-bit resolution implemented by driving the IC with a 6-bit as an example, the 6-bit driver IC can implement high voltage signals of 124 and 128, and the low voltage signals of 56 and 60 through the frame rate control and a frame displayed in four frames. In order to achieve a combination of the high voltage signal 125 and the low voltage signal 57, the high voltage signal 125 is required to be spatially and temporally matched by the high voltage signals 124 and 128, the low voltage signal 57 is required to be spatially and temporally matched by the low voltage signals 56 and 60.

The frame rate control is a use of the human eye of the visual inertia, through the way to achieve the target of gray color display method. Wherein the color mixture can be divided into space mixing and color mixing on time in order to display better by using both the color mixing method usually.

Specifically, as shown in FIG. 4, one implementation of step S100 comprises the following: A1-128 indicating the voltage signal of the sub-pixel A1 is 128. The sub-pixel A1 is one of the sub-pixels in the first pixel unit. The sub-pixel A1 may be one of a red sub-pixel, a green sub-pixel, and a blue sub-pixel. A1, A2, A3, A4, A5, A6, A7 and A8 are the same color of the sub-pixels (red sub-pixels, green sub-pixels, or blue sub-pixels) according to the naming convention described above, and the sub-pixels A1 and A2, A3 And A4, A5 and A6, A7 and A8 belong to different pixel groups.

Specifically, in step S200, four frames are used as one image display period.

Specifically, one implementation of step S300 comprises the following: sub-pixels A1, A4, A5 and A8 belonging to the first pixel unit in the different pixel group, which are driven by the first voltage signal (high voltage signal). Sub-pixels A2, A3, A6 and A7 belonging to the second pixel unit in the different pixel group, which are driven by the second voltage signal (low voltage signal).

Specifically, one implementation of step S400 comprising the following contents:

in the first frame, the sub-pixels A1, A4, A5 and A8 of the first voltage signals are 128, 124, 124, and 124;

the sub-pixel A2, A3, A6 and A7 of the second voltage signal are 56, 56, 60 and 56. In the second frame, the sub-pixels A1, A4, A5, and A8 of the first voltage signals are 124, 124, 128, and 124; the second voltage signals of the sub-pixels A2, A3, A6, and A7 are 60, 56, 56 And 56. In the third frame, the sub-pixels A1, A4, A5 and A8 of the first voltage signals are 124, 128, 124 and 124; the second voltage signals of the sub-pixels A2, A3, A6 and A7 are 56, 56, 56 And 60. In the fourth frame, the sub-pixels A1, A4, A5 and A8 of the first voltage signals are 124, 124, 124 and 128, the second voltage signals of the sub-pixels A2, A3, A6 and A7 are 56, 60, 56 and 56.

On the one hand, in the first frame, the average signal of the first voltage signal of the sub-pixels A1, A4, A5 and A8 is: (128+124+124+124)/4=125.

In the second, third and fourth frame, the average signal of the first voltage signal of the sub-pixels A1, A4, A5, and A8 is 125, and it same as the average signal of the first voltage of the sub-pixels A1, A4, A5, and A8.

On the other hand, in the first frame, the average signal of the second voltage signal of the sub-pixels A2, A3, A6 and A7 is: (56+56+60+56)/4=57

In the second, third and fourth frame, the average signal of the second voltage signal of the sub-pixels A2, A3, A6, and A7 is 57, and it same as the average signal of the second voltage of the sub-pixels A2, A3, A6, and A7.

Thus, the average signal of the first voltage signal (high voltage signal) of the same color of the sub-pixel is 125 in space (i.e., in each frame). The second voltage signal (low voltage signal) of the same color of the sub-pixel of the average signal is 57. Specifically, as shown in Table 1 below:

TABLE 1

| Voltage Signal | Frame | | | |
|---|---|---|---|---|
| | First Frame | Second Frame | Third Frame | Fourth Frame |
| The average signal of the first voltage signal | 125 | 125 | 125 | 125 |
| The average signal of the second voltage signal | 57 | 57 | 57 | 57 |

On the one hand, as shown in FIG. 4, the average signal of the first voltage signal of the sub-pixel A1 in the four frames is: (128+124+124+124)/4=125

The average signal of the first voltage signal of the sub-pixels A4, A5 and A8 is 125, which is the same as the average signal of the first voltage signal of the sub-pixel A1.

On the other hand, the average signal of the second voltage signal of the sub-pixel A2 in the four frames is: (56+60+56+56)/4=57.

It is further to obtain that the average signal of the second voltage signal of the sub-pixels A3, A6 and A7 is 57, which is the same as the average signal of the second voltage signal of the sub-pixel A2.

Thus, the average signal of the first voltage signal of the sub-pixels A1, A4, A5 and A8 (high voltage signal pixel unit) is 125 from the view of time (i.e., within four frames). The average signal of second voltage signal of the sub-pixels A2, (Low voltage signal pixel unit) is 57. Specifically, as shown in Table 2 below:

| Sub-pixels | First Frame | Second Frame | Third Frame | Fourth Frame | Average Aignal |
|---|---|---|---|---|---|
| A1 | 128 | 124 | 124 | 124 | 125 |
| A2 | 56 | 60 | 56 | 56 | 57 |
| A3 | 56 | 56 | 56 | 60 | 57 |
| A4 | 124 | 124 | 128 | 124 | 125 |
| A5 | 124 | 128 | 124 | 124 | 125 |
| A6 | 60 | 56 | 56 | 56 | 57 |
| A7 | 56 | 56 | 60 | 56 | 57 |
| A8 | 124 | 124 | 124 | 128 | 125 |

Furthermore, the average signal of the first voltage signal in space and the average signal of the first voltage signal in time are both 125. The average signal of the second voltage signal on the space and the second voltage signal in time are both 57.

It is understood that to realize a screen display effect of a high voltage signal of 126 and a high voltage signal 127, a low voltage signal 58 and the low voltage signal 59 based on adjusting the spatial and temporal ratio of the first voltage signal and the second voltage signal. It could refer to FIG. 5 and FIG. 6.

Figure 8:
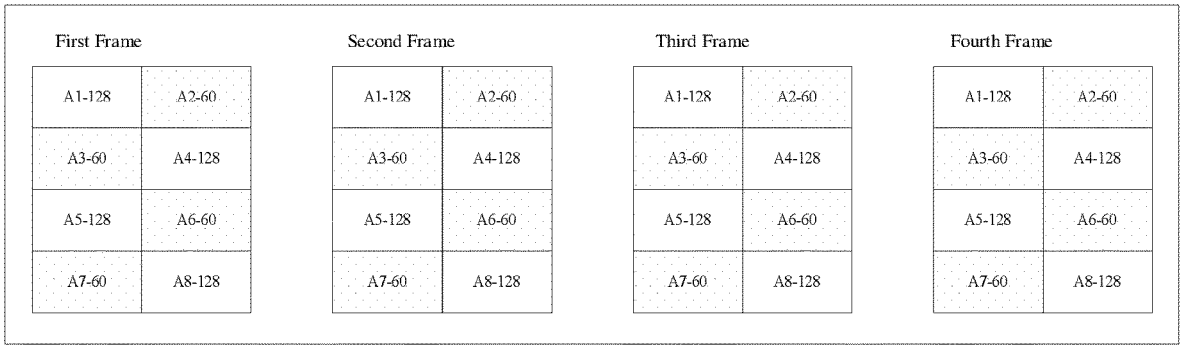
FIG. 8 is a schematic diagram of a voltage signal of a sub-pixel of another embodiment.

Furthermore, both the first voltage signal and the second voltage signal remain the same spatially and temporally (i.e., the first voltage signal and the second voltage signal remain unchanged in each frame image and each frame image), it achieves the combination that the high voltage signal to be 124; the low voltage signal to be 56; the high voltage signal to be 128 and low voltage signal to be 60. It could be referring to FIG. 7 and FIG. 8.

Figure 9:
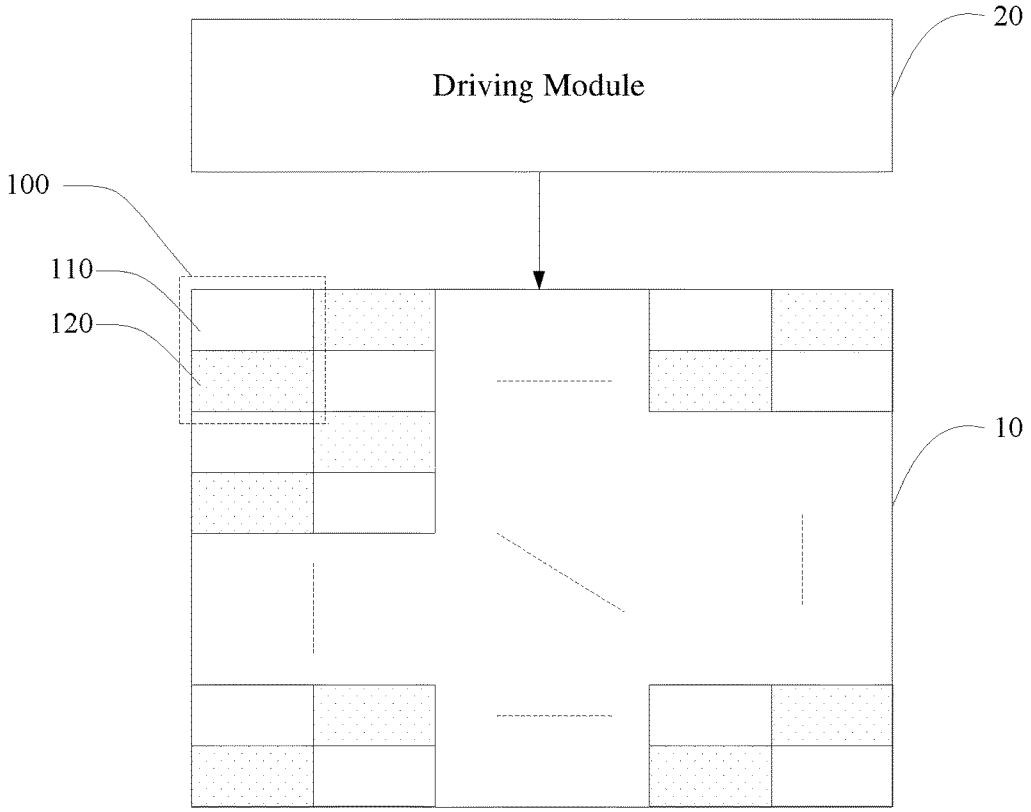
FIG. 9 is a schematic view of a display device of an embodiment.

In one of the embodiment, as shown in FIG. 9, a display device comprises:

a display panel 110 dividing into multiple pixel groups 100. Each of the pixel group 100 comprising a first pixel unit 110 and a second pixel unit 120 which are adjacent to each other;

a drive module 20 for sequentially displaying each frame using four frames and acquiring a first voltage signal and a second voltage signal for each pixel group 100. And adjusting the first voltage signal and the second voltage signal so that the average signal of all the first voltage signals of each frame image is the same. The average signal of all the second voltage signals of each frame image is the same, and the average signal of the first voltage signal of the different pixel group 100 in the multiple frame image is the same. The second voltage signal of the different pixel group 100 is the same as the average signal in the multi-frame image. Wherein the first voltage signal drives the first pixel unit 110 and the second voltage signal drives the second pixel unit 120, and the first voltage signal is not equal to the second voltage signal.

In one embodiment, a first pixel unit of one of the two pixel groups and a second pixel unit of another pixel group are arranged adjacent in the display panel.

In the present embodiment, two pixel groups are two adjacent pixel groups in the row direction or the column direction.

Figure 10:
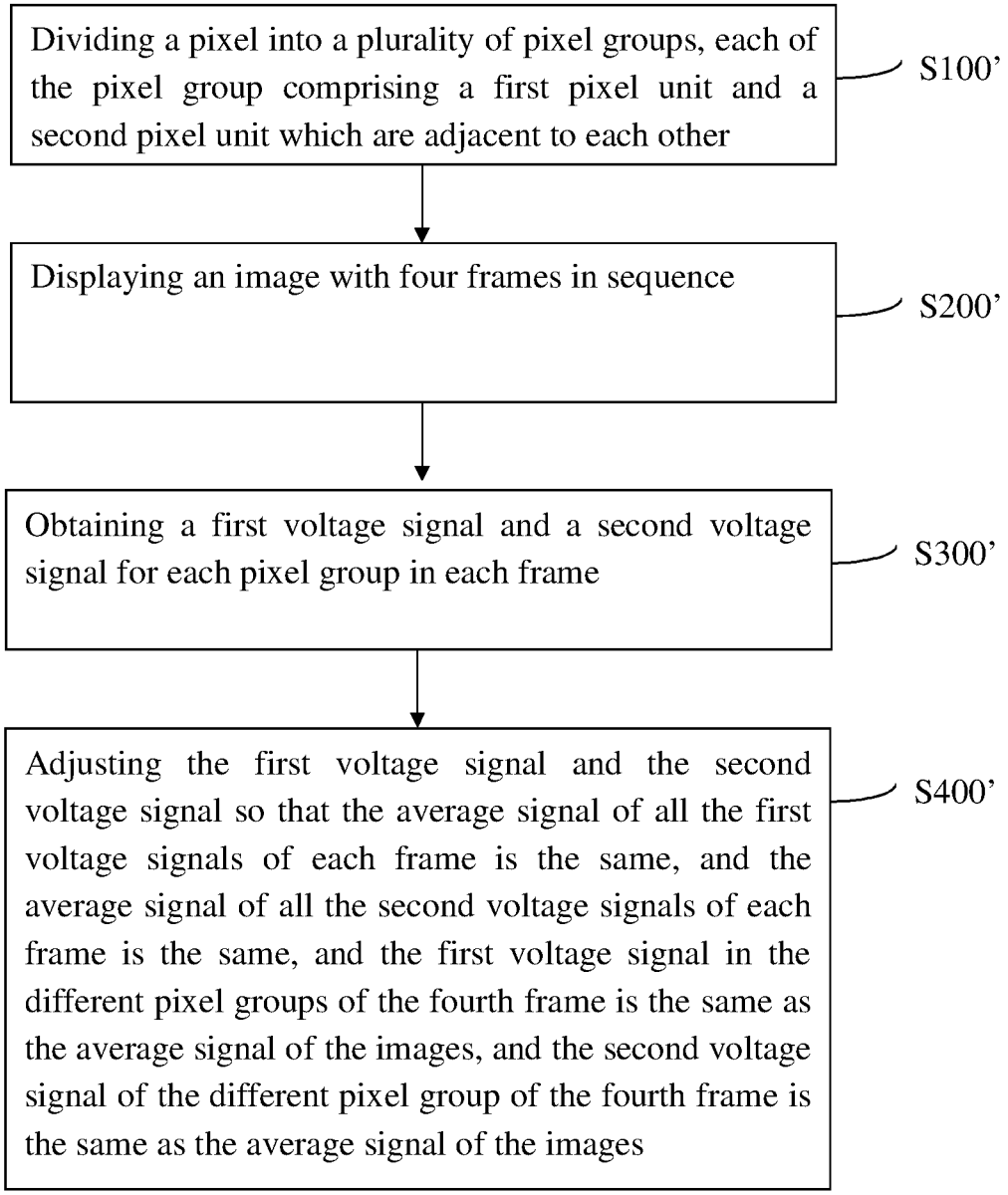
FIG. 10 is a flow chart of a driving method of a display panel according to another embodiment.

In one embodiment, as shown in FIG. 10, the drawing is a flow chart of a driving method of a display panel. When the display period of one picture is four frame periods and the first voltage signal is higher than the second voltage signal, the step of the method comprises as below:

Step S100: dividing a pixel into a plurality of pixel groups and each of the pixel group comprising a first pixel unit and a second pixel unit are adjacent to each other;

Step S200: displaying an image with four frames in sequence;

Step S300: obtaining a first voltage signal and a second voltage signal for each pixel group in each frame, wherein the first pixel unit is driven by the first voltage signal and the second pixel unit is driven by the second voltage signal, and the first voltage signal being higher than said second voltage signal;

Step S400: adjusting the first voltage signal and the second voltage signal so that the average signal of the first voltage signals of each frame is the same. The average signal of all the second voltage signals of each frame is the same, and the first voltage signal in the different pixel groups is the same as the average signal of the images. The second voltage signal of the different pixel group is the same as the average signal of the images.

In the present embodiment, the first voltage signal is a high voltage signal with respect to the second voltage signal, so that the second voltage signal is a low voltage signal. In addition, the first voltage signal and the second voltage signal have different voltage signal values, and these voltage signal values represent the luminance signals displayed for each sub-pixel. In the above embodiment, by adjusting the sub-pixel luminance signals in each frame and four frame periods makes the luminance signals of the respective sub-pixels remain in the respective average luminance signals to be the same in each frame (spatially) and in four frames (temporally).

The driving method and the display device of the display panel use the high and low voltage pixel driving modes of the multiple frame period so that the average signal of all the high voltage signals of each frame image is the same. The average signal of all the low voltage signals of each frame image is the same. The high voltage signal of the pixel group is the same as the average signal of the multiple frame image, and the low voltage signal of the different pixel group is the same as the average signal of the multiple frame image. Therefore, the timing of the same brightness signal solves the problem of low-frequency brightness flicker.

The embodiments described above are merely illustrative of several embodiments of the present application and are more specific and detailed. But it is not to be construed as the limitation of the scope of the patent application. It should be noted that various modifications and improvements can be made by those skilled in the art without departing from the spirit of the present application. Accordingly, the scope of protection of the present patent application is subject to the claims Disclosures above is a further detailed description of the disclosure in conjunction with specific alternative embodiments, and the specific embodiments of the disclosure should not be construed as being limited to this description. It will be apparent to those skilled in the art from this disclosure that various modifications or substitutions may be made without departing from the spirit of the disclosure and are intended to be within the scope of the disclosure.

What is claimed is:

1. A driving method of a display panel, comprising:

dividing a pixel into a plurality of pixel groups, each of the pixel groups comprising a first pixel unit and a second pixel unit wherein the first pixel unit and the second pixel unit are adjacent to each other;

displaying an image with four frames in sequence; and obtaining a first voltage signal and a second voltage signal for each of the pixel groups in each frame, wherein the first pixel unit is driven by the first voltage signal, the second pixel unit is driven by the second voltage signal, and the first voltage signal being higher than said second voltage signal;

adjusting the first voltage signal and the second voltage signal so that the average signal of the first voltage signals of each frame is the same, and the average signal of all the second voltage signals of each frame is the same, and the first voltage signal in another of the pixel groups is the same as the average signal of the images, and the second voltage signal of another of the pixel groups is the same as the average signal of the images.

2. A driving method of a display panel, comprising:

dividing the pixel into at least one pixel group, each of the pixel groups comprises a first pixel unit and a second pixel unit wherein the first pixel and the second pixel are adjacent to each other;

displaying image with at least one frame in sequence;

obtaining a first voltage signal and a second voltage signal for each pixel group in each frame; wherein the first pixel unit is driven by the first voltage signal, the second pixel unit is driven by the second voltage signal, and the first voltage is not equal to the second voltage signal;

adjusting the first voltage signal and the second voltage signal so that the average signal of all the first voltage signals of each frame is the same, and the average signal of all the second voltage signals of each frame is the same, the first voltage signal of another of the pixel groups is the same as the average signal of at least one frame, and the second voltage signal of another of the pixel groups is the same as the average signal of at least one frame.

3. The driving method according to claim 2, wherein the first pixel unit and the second pixel unit are arranged adjacent in the same row.

4. A driving method according to claim 3, wherein the first pixel unit of one of the two adjacent pixel groups is neighboring to the second pixel unit of the other of pixel groups in the same row.

5. The driving method according to claim 4, wherein at least one frame image is the four frame image.

6. The driving method according to claim 4, wherein the first voltage signal is higher than the second voltage signal.

7. The driving method according to claim 2, wherein the first and second pixel units are arranged adjacent in the same row.

8. The method according to claim 7, wherein the image is the four frame image.

9. The method according to claim 7, wherein the first pixel unit of one of the pixel groups is neighboring to the second pixel unit of the other of pixel groups in the same row.

10. The method according to claim 9, wherein the first voltage signal is higher than the second voltage signal.

11. The method according to claim 2, wherein the image is the four frame image.

12. The method according to claim 2, wherein the first voltage signal is higher than the second voltage signal.

13. A display device, comprising:

a display panel dividing into at least one pixel group, each of the pixel group comprising a first pixel unit and a second pixel unit which are adjacent to each other;

a driving module for sequentially displaying each image with at least one frame and obtaining a first voltage signal and a second voltage signal for each pixel group in each frame; wherein the first pixel unit is driven by the first voltage signal, the second pixel unit is driven by the second voltage signal, and the first voltage is not equal to the second voltage signal;

adjusting the first voltage signal and the second voltage signal so that the average signal of all the first voltage signals of each frame is the same, and the average signal of all the second voltage signals of each frame is the same, the first voltage signal of another of the pixel groups is the same as the average signal of at least one frame, and the second voltage signal of another of the pixel groups is the same as the average signal of at least one frame.

14. The display device according to claim 13, wherein first pixel unit of one of the two pixel groups and a second pixel unit of another pixel group are arranged adjacent in the display panel.

15. The display device according to claim 14, wherein the first pixel unit and the second pixel unit are arranged adjacent in the same row.

16. The display device according to claim 15, wherein the first pixel unit of one of the two adjacent pixel groups and the second pixel unit of the other pixel group are arranged adjacent in the same row.

17. The display device according to claim 14, wherein the first pixel unit and the second pixel unit are arranged adjacent in the same column.

18. The display device according to claim 17, wherein the first pixel unit of one of the two pixel groups and the second pixel unit of the other pixel group are arranged adjacent in the same row.

19. The display device according to claim 13, wherein at least one frame image is the four frame image.

20. The display device of claim 13, wherein the first voltage signal is higher than the second voltage signal.

* * * * *